US005108012A

United States Patent [19]

Rosso

[11] Patent Number: 5,108,012

[45] Date of Patent: Apr. 28, 1992

[54] DISPENSER FOR ELONGATED FOODSTUFFS, PARTICULARLY PASTA

[75] Inventor: Antonio V. Rosso, Cavenago di Brianza, Italy

[73] Assignee: Walu Two B.V., Amsterdam, Netherlands

[21] Appl. No.: 564,414

[22] Filed: Aug. 8, 1990

[51] Int. Cl.[5] ..... B65D 83/06

[52] U.S. Cl. ..... 222/200; 222/234; 222/367; 222/404

[58] Field of Search ..... 222/162, 166, 167, 169, 222/185, 196, 199, 200, 227, 233, 243, 252, 254, 367, 368, 370, 556, 404, 450, 451, 452, 639; 99/407; 221/200, 236, 266, 297, 98

[56] References Cited

U.S. PATENT DOCUMENTS 4,576,209 3/1986 Eisenberg ..... 222/367

4,619,379 10/1986 Biehl ..... 222/153

FOREIGN PATENT DOCUMENTS 533535 10/1976 U.S.S.R. ..... 222/199

734569 8/1955 United Kingdom ..... 221/236

*Primary Examiner*—Kevin P. Shaver

*Assistant Examiner*—Philippe Derakshani

*Attorney, Agent, or Firm*—Robert Louis Finkel

[57] ABSTRACT

A device for dispensing predetermined quantities of, for example, spaghetti, includes a hopper containing a supply of the pasta. An outlet in the hopper deposits the spaghetti at the upper end of a vibrating slide. The vibration causes the spaghetti to move toward a chute at the slide's lower end. An arm hinged to the upper end of the plate carries an axially moveable blade and an end plate. Rocking the arm positions the blade intermittently to interrupt the movement of the spaghetti to the chute and alternately positions the end plate to allow the batch of spaghetti accumulated in the chute to drop into a batch container positioned below it. The position of the blade on the arm determines the quantity of pasta in each batch. An articulated carrier moves the loaded batch container to a dispensing location and discharges its contents.

10 Claims, 3 Drawing Sheets

DISPENSER FOR ELONGATED FOODSTUFFS, PARTICULARLY PASTA

BACKGROUND OF THE INVENTION

1. Field of the Invention

The present invention relates to a device for dispensing elongated foodstuffs, particularly pasta in filament form.

2. Prior Art

Known dispensers of this type comprise a hopper containing the foodstuff, for example elongated pasta in filament form, such as spaghetti. The hopper includes an outlet provided with a plurality of adjustable blade elements arranged in a predetermined sequence to identify a batch of the product which, catching in the blade elements, is then conveyed to the inlet of a machine adapted to process that product.

The disadvantage of those devices is that it is sometimes difficult to identify the specific, pre-selected batch and that the units of the product comprising the batch are not always brought closer together in a parallel position as required, so that they cannot subsequently be brought into alignment and conveyed to the opening of the processing machine in a proper fashion.

The object of the present invention is to provide a dispenser capable of eliminating the aforesaid disadvantages and permitting the separation of a very specific batch of the product and the proper positioning of the units of the product comprising the batch, to facilitate subsequent processing.

A further object of the invention is to provide a dispenser that is easy to manufacture and equally easy to operate in solving the aforesaid disadvantages.

BRIEF SUMMARY

The aforesaid objects of the present invention are achieved by means of a dispenser of elongated foodstuffs, particularly pasta in filament form, which comprises a hopper, elements that separate out a batch of the product and finally, an element capable of collecting and containing the product to be introduced into a processing machine, characterized by the fact that said elements for separating out a batch of the product include a flat element mounted on a slant below a hopper outlet, to which is connected a downward-facing blade element that is substantially adjustable in a direction parallel to the surface of that element, said flat element being caused to oscillate and vibrate with respect to a base frame supporting the respective blade element, and by the fact that the element collecting and containing the batch of the product to be dispensed substantially comprises a cylindrical container with a longitudinal opening in a portion of its lateral surface, capable of being alternatively opened and positioned below the free end of the flat element in order to receive the batch of the product, and closed and repositioned next to an inlet of said processing machine.

For a fuller understanding of the structural and functional characteristics and the advantages of a dispenser according to the present invention, reference should be made to the following illustrative and non-restrictive description taken in connection with the accompanying drawings, in which:

DRAWINGS

DETAILED DESCRIPTION

Figure 1:
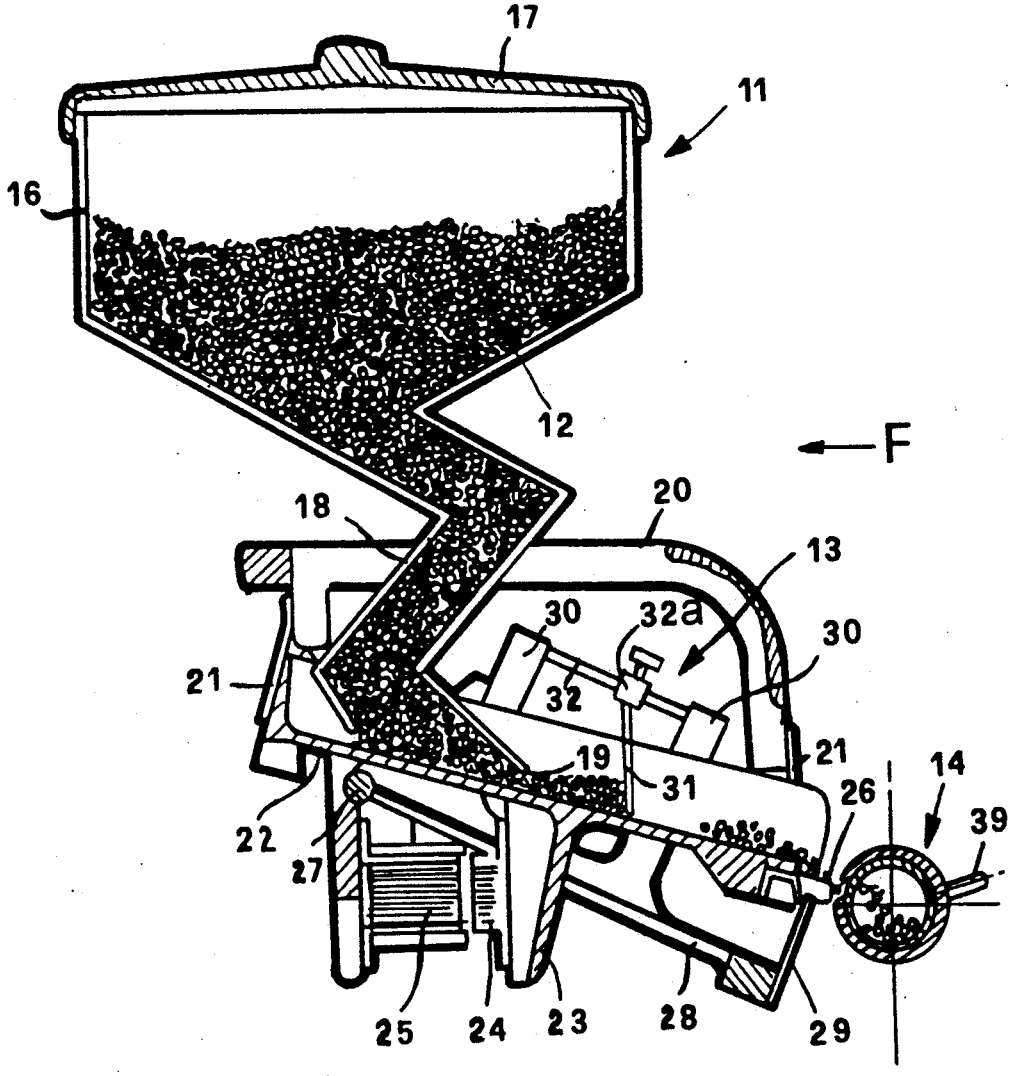
FIG. 1 is a side elevational view, with parts broken away, of a dispenser embodying the features of the present invention.

Referring to the drawings, it will be seen that a dispenser according to the invention substantially comprises a hopper 11, containing filament-shaped foodstuffs of an elongated form 12 such as pasta or spaghetti, elements separating out a batch of the product, located in the middle of the device and generally indicated as 13, and finally an element 14 capable of collecting and containing the separated batches of the product. This dispenser is positioned near an inlet of a subsequent machine (not shown) which processes the batch of the product to be dispensed, provided with a stop valve such as a ball valve 15.

The hopper 11 is provided with a hollow parallelepipedshaped upper body, equipped with a lid 17, and having a lower, elongated Z-shaped portion 18 with a lower outlet 19 provided above the separating elements 13.

Those elements 13 include a base frame 20, on which a flat element 22 acting as an oscillating and vibrating "side" is mounted to the front and rear by means of flat band-like elements 21, made of music wire, for example. An appendix 23 projecting below the flat element 22 supports a sheet metal structure 24 capable of interacting and working with a complementary laminar electromagnet 25 anchored to the base frame 20.

The portion of flat element 22 farthest from the outlet 19 of the hopper 11 is normally slanting downward; attached to the hopper is a chute-like element 26, made of a flexible plastic, for example, which is normally aligned with the flat element 22. Also supported by the base frame 20 and hinge 27, above flat element 22, is the end of an oscillating arm 28 whose other, free end is equipped with an arcuate plate 29 turned upward, and which inhibits rocking of the flexible chute-like element 26. Furthermore, the upward-facing posts 30 of the oscillating arm 28 support a pilot bar 32 to which a downwardly extending blade or vane element 31 is slidably mounted for movement longitudinally of element 22 by means of manually adjustable slide **32*a*. Convenient restraining means, such as a thumbscrew on slide 32*a* allows blade 31 to be immobilized in any desired location downstream of outlet 19. The blade element 31 is thus readily moveable in a direction substantially parallel to the surface of flat element 22 and stops the product before it reaches the chute-like element 26**.

An element 14 collecting and containing the batch of the separated product is positioned, as stated above, to meet the free end of the flat element 22 or, even better, the end of the chute-like element 26. That element 14 comprises a cylindrical container with two coaxial walled portions 33 and 34, one inside the other; substantially similar longitudinal openings, 35 and 36 respectively, are provided on a portion of their lateral surfaces that, when aligned, are capable of receiving the end of the chute-like element 26 and consequently the batch of the product selected on flat element 22.

Figure 2:
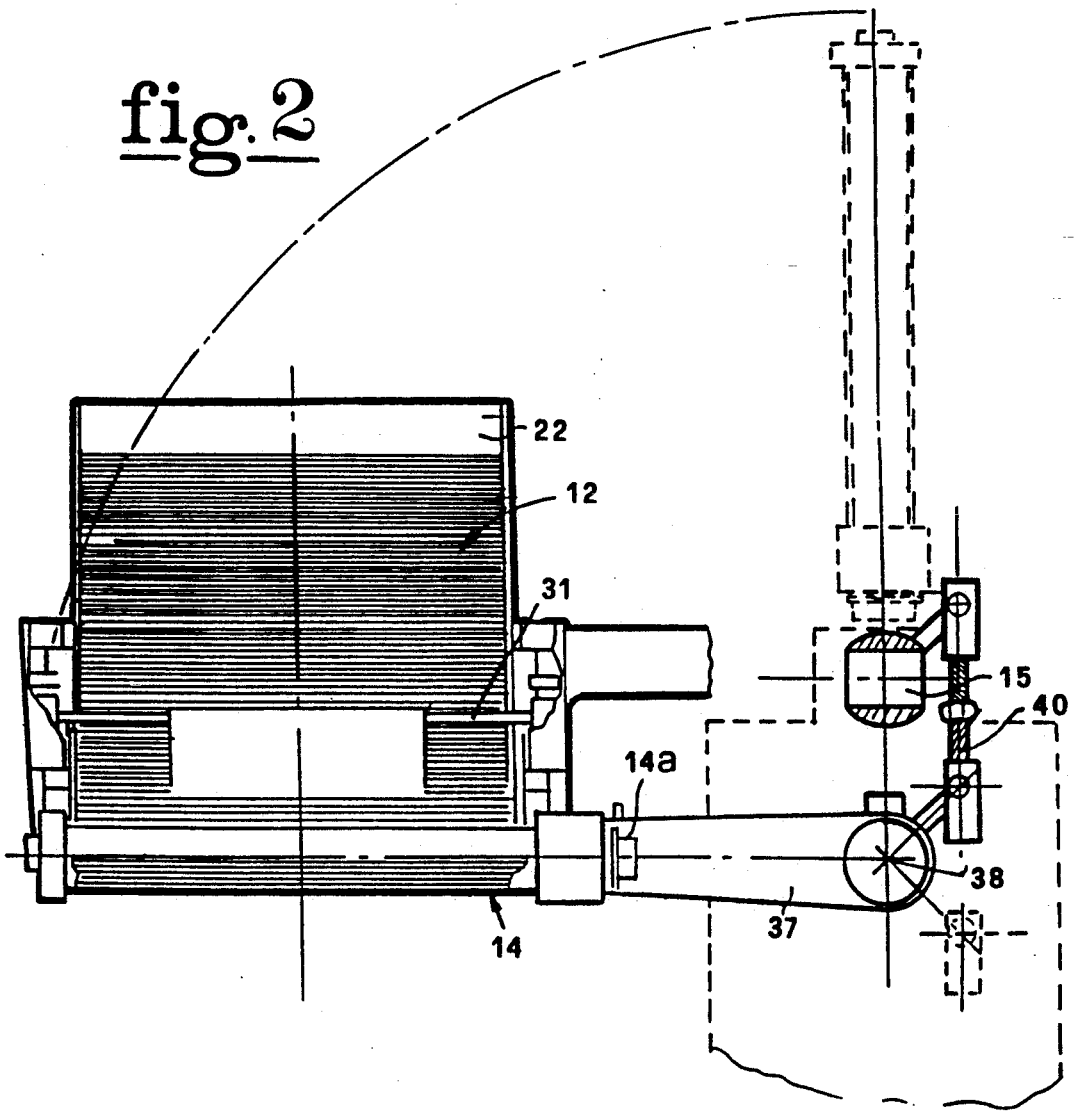
FIG. 2 is an elevational view, taken on arrow F, of a detail of the device shown in FIG. 1.
Figure 4:
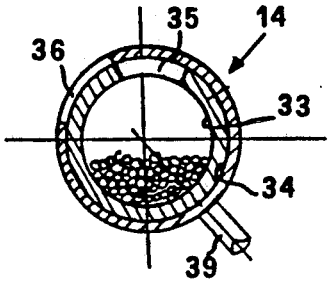
FIG. 4 is a detail, with parts broken away, taken on line IV—IV of FIG. 3.

The collecting and containing element 14 is solidly anchored and axially aligned with a subsequent arm 37 that is hinged to the frame of the device at 38 and may be caused to rotate 90° until it meets valve 15 at the inlet of a processing machine (FIG. 3) The reciprocal movement between the two walled portions 33 and 34 of the cylindrical container is driven by a lever 39, while the rotation of the container between the position underneath the free end of the flat element 22, where it receives the batch, and the position whereby the container meets the inlet, is permitted by traction lever mechanisms with adjustable rods 40 rigidly anchored to the rear arm 37 and capable of simultaneously rotating the ball valve 15. The collecting and containing element 14 must also be fitted with an end wall having a movable closure 14*a* which opens only when the element 14 is in its upright position as illustrated in FIG. 2. When the ball valve 15 has been rotated to the "open" position shown in FIG. 3, actuating means (not shown here) rotate or displace the closure 14*a* into the position indicated by numeral 14*a*', clear of the end of cylinder 14, thereby permitting the contents of the cylinder to fall through valve 14 into the processing machine.

The operation of a dispenser according to the present invention is as follows.

The hopper 11 is filled with a foodstuff 12 such as spaghetti, which must be fed into the processing machine in pre-selected and successive batches.

The dispenser will thus be in the position shown in FIG. 1 with the simple difference that no presence of the product will be found, either on the free end of the flat element 22 or inside the cylindrical container 14. At this point, actuating means not shown here establish the anticlockwise movement of the oscillating arm 28, which consequently raises the blade element 31. At the same time, the oscillation and vibration of the flat element 22 are established by the activation of the electromagnet 25, which acts on the sheet metal structure 24.

Figure 3:
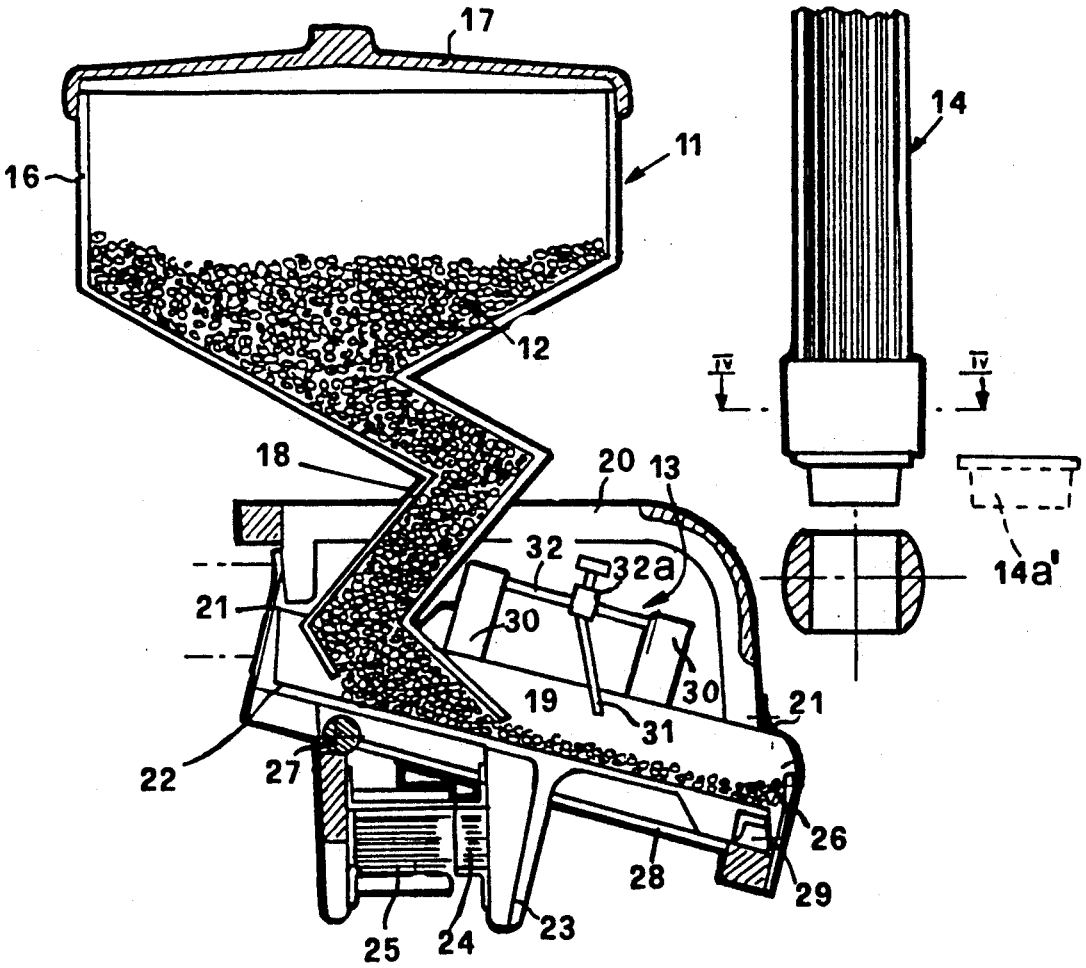
FIG. 3 is a view similar to that of FIG. 1, but from a different operating position.

The foodstuff 12 thus tends to slide down along the slanted flat element 22 and, as shown in FIG. 3, stops against the chute-like element 26 raised toward the top of the plate 29, which is an integral part of the oscillating arm 28.

After a predetermined time period permitting the passage of the pre-selected batch, the oscillating arm 28 is brought down so that the blade element 31, interacting with the surface of the flat element 22, stops additional material from descending from outlet 19 of hopper 11. The lowering of the oscillating arm 28 also permits the simultaneous lowering of the chute-like element 26 positioned at the longitudinal openings 35 and 36 meeting the collecting and containing element 14. That position permits the batch of the product 12 to descend into the cylindrical container.

The lever 39 is then rotated to close the cylindrical container before the latter, supported by the aforesaid arm 37, is rotated and positioned to meet the inlet of the processing machine where the ball valve 15 is located. In the embodiment shown, the traction lever mechanisms equipped with rods 40, solidly anchored to the arm 37, simultaneously open the ball valve 15 while the cylindrical container is above the latter. Only at this point does the mobile wall 14*a* of the cylindrical container open, permitting the batch of the product in the container to be fed into the processing machine below.

When that operation is complete, the aforesaid arm 37 brings the cylindrical container back to the chute-like element 26 and thus the flat element 22, and the loading cycle of the cylindrical container is repeated, after the longitudinal openings 35 and 36 of the same are realigned in the open position to receive a batch of the product and end wall 14*a* is replaced.

In a dispenser according to the present invention, the particular arrangement of the components allows for a smaller top section, permitting, as in the particular embodiment shown, the simultaneous operation of the cylindrical container containing the batch and the ball valve at the machine inlet.

Dispensing the product by means of the flat element that oscillates and vibrates at an adjustable frequency permits the ample and accurate adjustment of the product's dispensing, while ensuring the correct feeding position of the elongated product. The ability to adjust the blade element that stops the product emerging from the hopper onto the underlying flat element is also advantageous.

The particular Z-shape of the lower portion of the hopper outlet also makes it possible to securely maintain the upright position of the product in the hopper, even when it was previously fed in at random, allowing the elongated, filament-shaped foodstuff to exit in a homogenous and parallel fashion.

I claim:

1. A device for dispensing predetermined quantities of elongated foodstuffs, particularly pasta in filament form, to a processing machine having an inlet for receiving such foodstuffs, said device comprising:

a base frame;

a hopper for such foodstuff mounted to said base frame, said hopper having an outlet;

a slide mounted to said base frame, the upper end of said slide being positioned below said outlet for receiving such foodstuff, and the lower end of said slide defining a chute with a free end for discharging such foodstuff;

vibrational means mounted to said base frame for causing said slide to vibrate, whereby foodstuff on said slide is caused to move in a path toward said chute under the influence of gravity;

a first arm mounted to said base frame for oscillation in a plane generally normal to said slide;

drive means mounted to said base frame and operatively connected to said first arm, for causing said arm to oscillate;

a blade dependingly mounted to said first arm intermediate said outlet and said chute, said blade being adapted on oscillation of said arm to intersect said path intermittently and thereby interrupt the movement of foodstuff on said slide;

a container mounted to said base frame, means for positioning said container adjacent said chute for receiving a batch of such foodstuff from said chute, and for repositioning said container adjacent the inlet of said processing machine for discharging said batch of foodstuff into said inlet.

2. A device as defined by claim 1, wherein said blade is moveable axially on said first arm.

3. A device as defined by claim 2, wherein said first arm is pivotably mounted to said base frame.

4. A device as defined by claim 3, further comprising an upstanding plate mounted to said first arm adjacent said chute, said plate on oscillation of said first arm intermittently interrupting the discharge of foodstuff from said chute.

5. A device as defined by claim 4, wherein:

said chute is flexible; and on oscillation of said first arm, said plate intermittently engages and raises the free end of said chute, thereby interrupting the discharge of foodstuff from said chute.

6. A device as defined by claim 3, comprising:

a second arm mounted to said base frame and operatively connected to said container for so positioning and repositioning said container.

7. A device as defined by claim 6, wherein said second arm is pivotably mounted to said base frame.

8. A device as defined by claim 7, comprising:

a generally cylindrical container;

a first opening in the wall of said container for receiving a batch of said foodstuff;

first closure means associated with said container for alternatively exposing and covering said first opening;

a second opening in one end of said container for discharging the contents of said container; and second closure means associated with said container for alternatively covering and exposing said second opening.

9. A device as defined in claim 8, comprising:

resilient support means mounting said slide to said base frame;

a metallic appendage on said slide; and said vibrational means comprising an electromagnet mounted to said base frame adjacent said appendage and in cooperation therewith causing said slide to vibrate.

10. A device for dispensing predetermined quantities of elongated foodstuffs, particularly pasta in filament form, to a processing machine having an inlet for receiving such foodstuffs, said device comprising:

a base frame;

a hopper for such foodstuff mounted to said base frame, said hopper having an outlet;

a slide mounted to said base frame, the upper end of said slide being positioned below said outlet for receiving such foodstuff, and the lower end of said slide defining a chute for discharging such foodstuff;

vibrational means mounted to said base frame for causing said slide to vibrate, whereby foodstuff on said slide is caused to move in a path toward said chute under the influence of gravity;

a first arm pivotably mounted to said base frame and oscillating in a plane generally normal to said slide;

a blade depending from said first arm intermediate said outlet and said chute, said blade on oscillation of said arm intermittently intercepting, and thereby interrupting the movement of foodstuff on said slide;

means for selectively positioning said blade axially on said first arm;

an upstanding plate mounted to said first arm adjacent said chute, said plate on oscillation of said first arm intermittently interrupting the discharge of foodstuff from said chute;

a second arm pivotably mounted to said base frame; and a generally cylindrical container mounted to said second arm, said container having a first opening in its wall for receiving a batch of said foodstuff, first closure means for alternatively exposing and covering said first opening, a second opening in one of its ends for discharging its contents, and second closure means for alternatively covering and exposing said second opening, said second arm positioning said container alternatively with said first opening adjacent said chute for receiving a batch of such foodstuff, and with said second opening adjacent the inlet of said processing machine for discharging the contents of said container into said inlet.

* * * * *